US009863444B2

(12) United States Patent
Erkkila

(10) Patent No.: US 9,863,444 B2
(45) Date of Patent: Jan. 9, 2018

(54) HYDRAULIC ENERGY RECOVERY SYSTEM

(71) Applicant: Hydac Technology GmbH, Sulzbach/Saar (DE)

(72) Inventor: Mikko Erkkila, Tampere (FI)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 382 days.

(21) Appl. No.: 14/423,826

(22) PCT Filed: Jul. 31, 2013

(86) PCT No.: PCT/EP2013/002269

§ 371 (c)(1),
(2) Date: Feb. 25, 2015

(87) PCT Pub. No.: WO2014/032757

PCT Pub. Date: Mar. 6, 2014

(65) Prior Publication Data

US 2016/0186785 A1 Jun. 30, 2016

(30) Foreign Application Priority Data

Aug. 28, 2012 (DE) ..... 10 2012 017 004

(51) Int. Cl.

| | |
|---|---|
| ***F15B 1/02*** | (2006.01) |
| ***F15B 21/14*** | (2006.01) |
| *F15B 13/04* | (2006.01) |

(52) U.S. Cl.

CPC ..... *F15B 1/024* (2013.01); *F15B 21/14* (2013.01); *F15B 2013/041* (2013.01); *F15B 2211/20546* (2013.01); *F15B 2211/20569* (2013.01); *F15B 2211/20576* (2013.01); *F15B 2211/212* (2013.01); *F15B 2211/214* (2013.01); *F15B 2211/265* (2013.01); *F15B 2211/88* (2013.01)

(58) Field of Classification Search

CPC ..... F15B 1/024; F15B 21/14; F15B 2211/20546; F15B 2211/20569; F15B 2211/20576

USPC ..... 60/414

See application file for complete search history.

(56) References Cited

U.S. PATENT DOCUMENTS

| | | | | |
|---|---|---|---|---|
| 5,505,043 A * | 4/1996 | Baginski | B66F 9/20 | 60/477 |
| 7,891,181 B2 * | 2/2011 | Baltes | B66F 9/22 | 60/414 |
| 2006/0011370 A1 * | 1/2006 | Foersterling | E01D 19/14 | 174/42 |

FOREIGN PATENT DOCUMENTS

| | | |
|---|---|---|
| DE | 698 17 343 T2 | 6/2004 |
| DE | 10 2005 052 108 A1 | 5/2007 |
| DE | 10 2005 061 990 A1 | 7/2007 |
| DE | 10 2008 015 729 A1 | 7/2009 |
| DE | 20 2009 004 071 U1 | 8/2010 |

(Continued)

*Primary Examiner* — Thomas E Lazo

(74) *Attorney, Agent, or Firm* — Wenderoth, Lind & Ponack, L.L.P.

(57) ABSTRACT

A hydraulic energy recovery system (101) has an output drive unit (103), which can be actuated by a driver (102), and by which a hydraulic motor-pump unit (104) can be driven. In at least one energy feed position, the motor-pump unit supplies an energy storage device (106) and/or working hydraulics (107) with fluid. In a recuperation position, the motor-pump unit discharges fluid under pressure from the energy storage device (106) at least to the working hydraulics (107) and/or is used to actuate the output drive unit (103).

27 Claims, 2 Drawing Sheets

(56) References Cited

FOREIGN PATENT DOCUMENTS

| | | | | | |
|---|---|---|---|---|---|
| DE | 10 2009 029 840 | A1 | | 1/2011 | |
| EP | 2570381 | A1 | * | 3/2013 | ..... B66F 9/22 |
| WO | WO 2011/140972 | A1 | | 11/2011 | |
| WO | WO 2012/066268 | A2 | | 5/2012 | |

* cited by examiner

HYDRAULIC ENERGY RECOVERY SYSTEM

FIELD OF THE INVENTION

The invention relates to a hydraulic energy recovery system.

BACKGROUND OF THE INVENTION

In light of the shortage of resources and the increasing impact of $CO_2$ on the environment, hybrid drive systems are increasingly used, for example, in automotive technology. The systems currently in use are mostly electromotive hybrids, in which electric energy obtained during braking operations is stored and the stored energy is converted again to drive energy, in order to assist the vehicle when in driving mode and, in particular, during accelerations. This system can reduce the drive capacity of the internal combustion engine functioning as the primary drive for comparable driving performances. A "down-sizing" of this kind not only results in a drop in consumption, but also allows the possibility of assigning particular vehicles to a more favorable emission class corresponding to a lower performance class. A significant disadvantage of electromotive hybrids, however, is the energy loss that occurs due to the steps of converting from mechanical energy to electric energy and back. The energy loss may amount to as much as 66%.

Due to the high energy density and the compact design of hydraulic systems, these goals may also be achieved by a hydraulic hybrid system. To provide additional drive torque for accelerations even at low speeds and starting from zero speed, and to boost the braking effect during braking operations, hydraulic energy is stored in such case in a hydraulic accumulator by a motor-pump unit, in order, when needed, to utilize the motor operation of the motor-pump unit for reconversion. Such a hydrostatic drive system including recovery of braking energy was previously disclosed by the applicant in WO 2011/116914.

However, that, due to the lower power loss in the hydraulic system as compared to electromotive hybrids, a very large surplus of energy is stored in the hydraulic accumulators. Hence, there is a demand on the part of the user to also harness this surplus energy for other purposes.

SUMMARY OF THE INVENTION

An object of the invention is to provide an improved hydraulic energy recovery system, in which the stored energy may be utilized in a variety of ways.

This object is basically achieved by a hydraulic energy recovery system having an output drive unit, which may be actuated by a drive unit, in particular, a shaft. By that drive unit, a hydraulic motor-pump unit may be driven. In at least one energy feed position, the motor-pump unit supplies an energy storage device and/or working hydraulics with fluid. In addition, the motor-pump unit, in a recuperation position or energy recovery position, delivers fluid under pressure from the energy storage device at least to working hydraulics and/or uses it for actuating the output drive unit.

In this way, for example, braking energy of the output drive unit can be stored, coming, for example, from the drive unit in the form of a motor, in the energy storage device. With this arrangement, advantageously the drive unit alone can brake or decelerate by the hydraulic energy recovery system. The energy stored in the energy storage device may then be used in a manner known per se, to return it to the output drive unit. According to the invention, however, the energy stored in the energy storage device in the form of a fluid under pressure may also be used, for example, to supply working hydraulics.

During the service life of motors, there are also often periods, in which the full available output of the motor is not needed. In such situations, desirably the energy is temporarily stored in storage. In this way, a motor may be advantageously operated at an approximately constant rate of speed and/or load level. In addition, the temporarily stored energy may be retrieved again from the energy storage device in times of load peaks. This arrangement is also relevant in terms of the design of the motor, because the motor must be designed solely for producing an average performance and not for top performance requirements.

The particular advantages of the system lie in the simplicity of the construction and in the universality of the applicability of the stored energy. In the hydraulic system, there are only minimal pressure losses since the number of valves is minimized, in contrast to comparable systems known in the prior art. As a result, the level of efficiency of the system is very high.

As previously explained, the energy temporarily stored in the energy storage device may be used to supply working hydraulics. As a result, the pump for the working hydraulics may be smaller dimensioned. Also, there is a lower fluid flow through the tank, so that the tank may also be smaller.

Another advantage of the energy recovery system according to the invention is that it withstands even the most extreme pressure differences, and is able to temporarily store these pressure differences in the energy storage device.

Furthermore, energy coming from the working hydraulics or directly from a supply pump may be stored in the energy storage device.

In addition, the system operates as a hydraulic transformer, by which the varying pressures in the energy storage device and in the working hydraulics are transformed into corresponding volume flows of a fluid.

A hydraulic supply pump parallel to the motor-pump unit drivable by the output drive unit is particularly advantageous. The supply pump supplies on its output side, the working hydraulics, and is connected via this output side to a supply connection of the motor-pump unit. The hydraulic supply pump is able to advantageously ensure the basic supply of hydraulic fluid for the working hydraulics. Furthermore, additional fluid may be conveyed by the supply pump of the motor-pump unit, so that any losses due to outflow or leakage may be compensated.

The supply pump is preferably a load sensing pump, which may be controlled by the working hydraulics. In this way, the required control complexity for the supply pump is minimized. Thus, apart from the load required of the working hydraulics, the supply pump is regulated to constantly ensure a sufficient supply of energy to the units downstream.

The energy recovery system is advantageously optimized, in that in the case of a larger delivery volume of the supply pump as compared to displacement of the motor-pump unit, the higher output pressure of the supply pump or motor-pump unit is present at the working hydraulics. This measure also serves to constantly ensure a sufficient supply of fluid at a high pressure.

A hydraulic transformer is formed in a particularly advantageous manner by the motor-pump unit and the supply pump, so that more energy may be fed into the energy storage device as compared to feeding by the motor-pump unit alone. In this case, the supply pump increases or "boosts" the performance of the motor-pump unit. In other words, it provides fluid at a pressure higher than the atmospheric tank pressure, so that the motor-pump unit is able to pump more fluid at a higher pressure into the energy storage device.

A supply line of the motor-pump unit may join a pressure line of the supply pump for the working hydraulics. A priority valve is connected in this supply line, which priority valve is designed preferably as a 2/2-way switching valve. The priority valve may also be designed in the form of a hydraulic flow divider in the pressure line. Such a hydraulic flow divider may advantageously divide a conveyed fluid volume flow into constant, equal partial quantities, independently of the respective differential pressures present at the flow divider, and conduct them to the consumers downstream. Thus, depending on the switching of the priority valve, the energy may also be fed by the supply pump completely into the working hydraulics. A non-return valve in the priority valve, operating in a locked position, ensures that only energy from the energy storage device or energy coming from the motor-pump unit is fed into the working hydraulics, whereas fluid may not be conveyed from the supply pump in the direction of the motor-pump unit. In this way, the motor-pump unit bolsters, if necessary, the delivery capacity of the supply pump.

A pressure sensor may be connected to the pressure line for the purpose of recording pressure values for a central control unit (central processing unit, CPU). In this way, the system may be optimally controlled and, in particular, harmful excess pressures in the system may be avoided by readjusting the remaining components accordingly.

The motor-pump unit, the energy storage device and the supply lines advantageously form a secondary hydraulic branch. That secondary hydraulic branch is referred to by experts as a "closed loop system". This secondary branch may, for example, be used as a pump for supplying the working hydraulics and any additional connected hydraulic consumers, and may withdraw the required energy from the output drive unit and/or from the energy storage device. Alternatively or in addition, the secondary branch may be used as a motor, for example, for actuating the drive unit, the supply pump and/or additional connected units.

For this purpose, the motor-pump unit can advantageously enable a 4-quadrant operating mode and may be preferably electrically controlled by the central control unit (CPU). With the 4-quadrant operating mode, energy can be converted individually and non-directionally. For example, kinetic energy coming from the output drive unit is converted to hydraulic energy or hydraulic energy is transformed into kinetic energy. Thus, the 4-quadrant operating mode contributes significantly to the universal applicability of the energy recovery system.

A constant pressure valve, which is preferably designed as a 2/2-way switching valve, is advantageously connected in the supply line from the motor-pump unit to the energy storage device. With the constant pressure valve, an accumulated level of pressure can be maintained in the energy storage device until it is needed again.

In addition, a pressure sensor may be connected to the supply line between the constant pressure valve and the energy storage device for the purpose of recording pressure values for the central control unit (CPU).

The energy storage device is formed at least by a hydraulic storage, preferably in the form of a bladder accumulator or piston accumulator.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
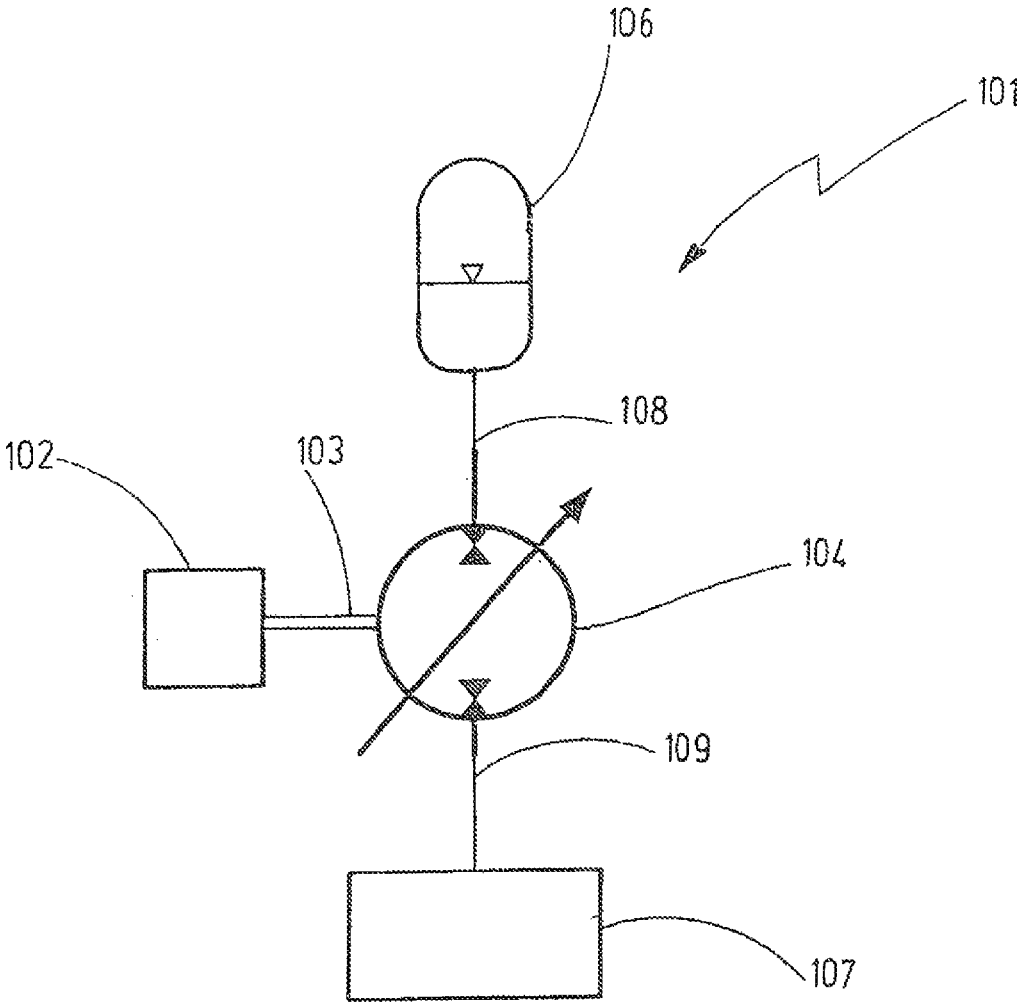
FIG. 1 is a highly schematic, simplified circuit diagram of a hydraulic energy recovery system according to a first exemplary embodiment of the invention.
Figure 2:
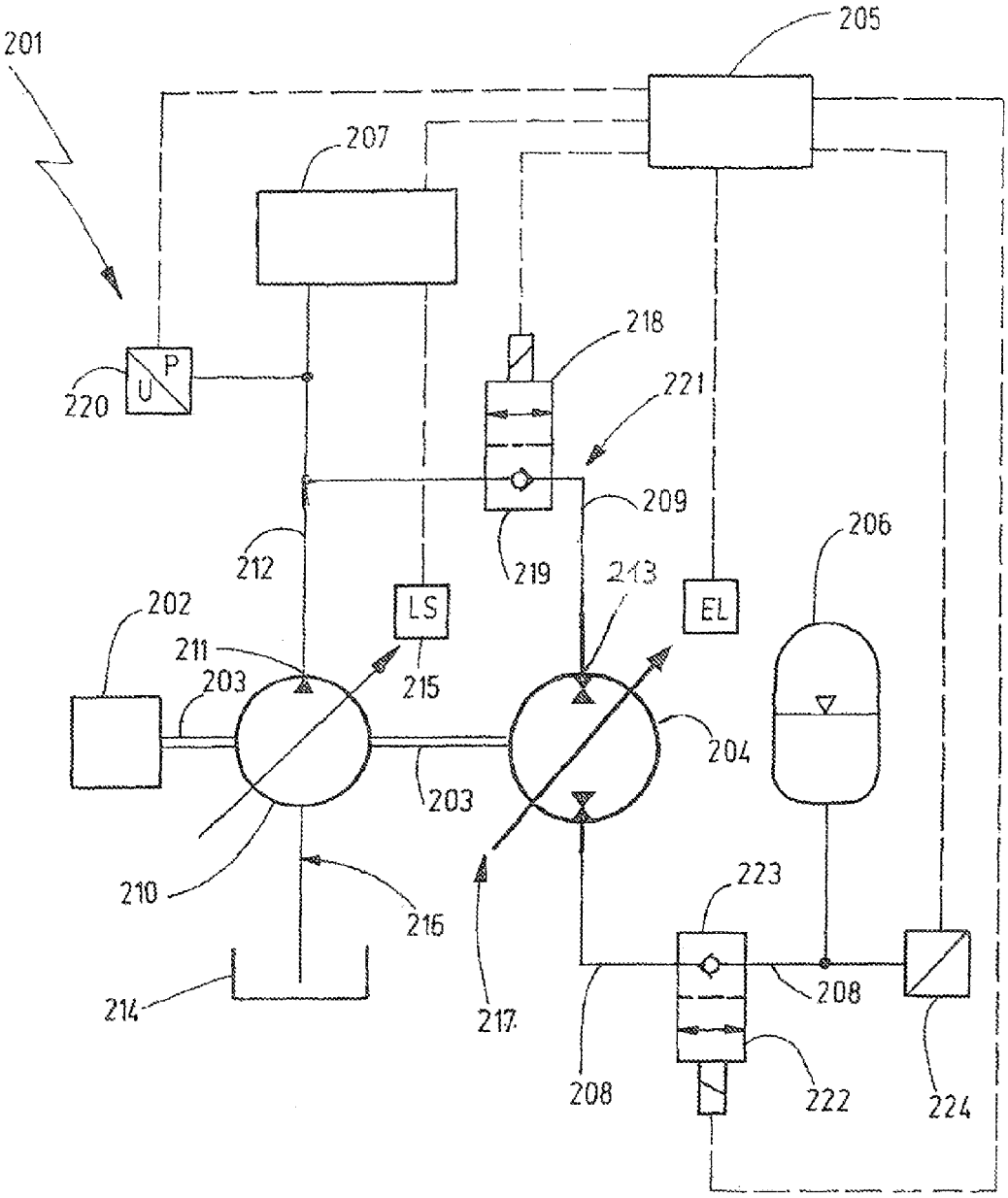
FIG. 2 is a circuit diagram of an energy recovery system according to a second exemplary embodiment of the invention, equipped with additional components.

FIGS. 1 and 2 show energy recovery systems 101, 201 according to exemplary embodiments of the invention. An output drive unit 103, 203, in particular, in the form of a shaft, may be actuated by a drive unit 102, 202. The output drive unit 103, 203 in this case, as is shown, may be driven directly or indirectly by a gear unit or drive gears (not shown). A hydraulic motor-pump unit 104, 204 is connected to the output drive unit 103, 203. The rotational energy of the shaft 103, 203 is converted to hydraulic energy by the motor-pump unit 104, 204.

The motor-pump unit 104, 204 may be operated in a 4-quadrant operating mode in multiple positions depending on the swivel angle. The swivel angle in this case is adjusted electrically by a central control unit (CPU) 205, cf. FIG. 2. In this way, in at least one energy feed position, the motor-pump unit 104, 204 supplies an energy storage device 106, 206 and/or working hydraulics 107, 207 with fluid. In a recuperation position, fluid under pressure is retrieved from the energy storage device 106, 206 and conducted to the working hydraulics 107, 207 or is converted into mechanical energy of the output drive unit 103, 203.

The energy storage device 106, 206 in this case is formed by a hydraulic accumulator in the form of a bladder accumulator. The hydraulic accumulator 106, 206 is connected to the motor-pump unit 104, 204 via an accumulator supply line 108, 208. The working hydraulics 107, 207 are, in turn, connected to the motor-pump unit 104, 204 via an oppositely facing working hydraulics supply line 109, 209. The working hydraulics 107, 207 may be an arbitrary hydraulic consumer.

In the expanded embodiment according to FIG. 2, a supply pump 210 is disposed on the output drive unit 203, which may be operated in parallel to the motor-pump unit 204. The supply pump 210, on the output side 211 thereof, supplies the working hydraulics 207 via a pressure line 212, and is also connected via this output side 211 in a fluid-conducting manner to a supply connection 213 of the motor-pump unit 204. The hydraulic supply pump 211 conveys fluid from a tank 214. The supply pump 210 in this case is implemented as a load sensing pump, which is controlled by a load signal 214 coming from the working hydraulics 207. The branch 216, which connects the tank 214 to the working hydraulics 207 via the supply pump 210, is also referred to as an "open loop system".

The supply line 209 coming from the motor-pump unit 204 joins pressure line 212 between the supply pump 210 and the working hydraulics 207. In this way, the working hydraulics 207 may be supplied with fluid by the supply pump 210 and the motor-pump unit 204. The two units 204, 210 are connected in such a way that in the case of a greater swivel angle of the supply pump 210 as compared to a swivel angle of the motor-pump unit 204, the higher output pressure of the supply pump 210 or the motor-pump unit 204 is present at the working hydraulics 207. This arrangement ensures a constantly high level of fluid pressure available at the working hydraulics 207.

The supply pump 210 and the motor-pump unit 204 are interconnected to form a hydraulic transformer 217. The fluid conveyed from the tank 214 is conveyed by the supply pump 210 at a high pressure to motor-pump unit 204, which increases the fluid pressure once again. The fluid is then fed to the energy storage device 206 via the supply line 208. In this way, a higher pressure level can be generated in the energy storage device 206. This process is also called "boosting" the fluid pressure.

To avoid a pressure drop at the working hydraulics 207 due to drainage in the direction of the motor-pump unit 204, a priority valve 218 is provided in the supply line 209 between motor-pump unit 204 and pressure line 212. This valve 218 has two switching positions and is accordingly designed as a 2/2-way switching valve. In one switching position, the priority valve 218 comprises a non-return valve 219, which blocks fluid flow in the direction of the motor-pump unit 204. In this switching position, all of the fluid of the supply pump 210 is passed on to the working hydraulics 207.

To monitor the pressure level in the pressure line 212, a pressure sensor 220 may also be provided in the pressure line 212. The pressure sensor 220 is coupled to the central control unit 205.

The motor-pump unit 204, the energy storage unit 206 and the supply lines 208, 209 form a secondary hydraulic branch 221, which is also referred to as a "closed loop system". The secondary branch 221 functions, depending on the relative pressure in the working hydraulics 207 relative to the energy storage device 206, as a pump for supplying the working hydraulics 207 and any additional connected hydraulic consumers. For this purpose, it uses energy, which originates from the output drive unit 203 or from the energy storage device 206. Depending on the relative pressure between the working hydraulics 207 and the energy storage device 206, the secondary branch 221 acts as a motor for boosting the drive unit 202, the supply pump 210 and, if necessary, additional connected units.

A constant pressure valve 222 in the supply line 208 between the motor-pump unit 204 and the energy storage device 206 is identical in design to the priority valve. In one switching position, the constant pressure valve 222 comprises a non-return valve 223, which opens in the direction of the energy storage device 206. The constant pressure valve 222 is designed as a 2/2-way switching valve. To monitor the pressure in the energy storage device 206, a pressure sensor 224 is connected to the supply line 208 between the constant pressure valve 222 and the energy storage unit 206 for the purpose of recording pressure values for the central control unit (CPU) 205.

Hence, the motor-pump unit 204, the priority valve 218, the constant pressure valve 222 and the pressure sensors 220, 224 in the pressure line 212 and in the supply line 208 are connected to the central control unit (CPU).

While various embodiments have been chosen to illustrate the invention, it will be understood by those skilled in the art that various changes and modifications can be made therein without departing from the scope of the invention as defined in the claims.

The invention claimed is:

1. A hydraulic energy recovery system, comprising:

a driver;

a first output drive coupled to and actuated by said driver;

a hydraulic motor-pump coupled to and driven by said first output drive, said motor-pump being in fluid communication with an energy storage and working hydraulics, supplying at least one of said energy storage or said working hydraulics with fluid in an energy feed position and discharging fluid under pressure from said energy storage at least one of to actuate said working hydraulics or to actuate said first output drive in a recuperation position;

a hydraulic supply pump coupled to and driven by a second output drive, said second output drive being parallel to said motor-pump, said supply pump having an output side being in fluid communication with and supplying said working hydraulics, said supply pump being connected in fluid communication on said output side to a supply connection of said motor-pump;

a supply line extending from said motor-pump joining a pressure line of said supply pump to said working hydraulics; and a priority valve connected to said supply line.

2. A hydraulic energy recovery system according to claim 1 wherein said priority valve comprises a 2/2-way switching valve.

3. A hydraulic energy recovery system according to claim 1 wherein said supply pump comprises a load sensing pump controllable by said working hydraulics.

4. A hydraulic energy recovery system according to claim 1 wherein said supply pump and said motor-pump are connected such that when a delivery volume of said sump pump is larger than a displacement of said motor-pump a higher output pressure of said sump pump or said motor-pump is present at said working hydraulics.

5. A hydraulic energy recovery system according to claim 1 wherein said motor-pump and supply pump form a hydraulic transformer feeding more energy into said energy storage as compared to feeding solely by said motor-pump.

6. A hydraulic energy recovery system according to claim 1 wherein a pressure sensor is connected to said pressure line and records pressure values for a central control.

7. A hydraulic energy recovery system according to claim 1 wherein said motor-pump unit and said energy storage are connected by supply lines to form a secondary hydraulic branch.

8. A hydraulic energy recovery system according to claim 7 wherein said secondary branch operates as a pump that supplies fluid pressure to said working hydraulics and to any other hydraulic consumers connected thereto, with energy for the fluid pressure originating from at least one of said first output drive or said energy storage; and said secondary branch operates as a motor that boosts at least one of said driver, said supply pump or connected units.

9. A hydraulic energy recovery system according to claim 1 wherein said motor-pump is operable in a four-quadrant operating mode and is electrically controllable by a central control.

10. A hydraulic energy recovery system according to claim 1 wherein a constant pressure valve is connected in a supply line extending from said motor-pump to said energy storage and comprises a 2/2-way switching valve.

11. A hydraulic energy recovery system according to claim 10 wherein a pressure sensor is connected to said supply line between said constant pressure valve and said energy storage and records pressure values for a central control.

12. A hydraulic energy recovery system according to claim 1 wherein said energy storage comprises a hydraulic accumulator.

13. A hydraulic energy recovery system according to claim 12 wherein said hydraulic accumulator is a bladder accumulator or a diaphragm accumulator.

14. A hydraulic energy recovery system according to claim 1 wherein said motor-pump is operable as a hydraulic transformer between said working hydraulics and said energy storage.

15. A hydraulic energy recovery system, comprising:

a driver;

a first output drive coupled to and actuated by said driver;

a hydraulic motor-pump coupled to and driven by said first output drive, said motor-pump being in fluid communication with an energy storage and working hydraulics, supplying at least one of said energy storage or said working hydraulics with fluid in an energy feed position and discharging fluid under pressure from said energy storage at least one of to actuate said working hydraulics or to actuate said first output drive in a recuperation position; and a hydraulic supply pump coupled to and driven by a second output drive, said second output drive being parallel to said motor-pump, said supply pump having an output side being in fluid communication with and supplying said working hydraulics, said supply pump being connected in fluid communication on said output side to a supply connection of said motor-pump, said supply pump being a load sensing pump controllable by said working hydraulics.

16. A hydraulic energy recovery system according to claim 1 wherein a supply line extends from said motor-pump joining a pressure line of said supply pump to said working hydraulics; and a priority valve is connected to said supply line; and said priority valve comprises a 2/2-way switching valve.

17. A hydraulic energy recovery system according to claim 15 wherein said supply pump and said motor-pump are connected such that when a delivery volume of said sump pump is larger than a displacement of said motor-pump a higher output pressure of said sump pump or said motor-pump is present at said working hydraulics.

18. A hydraulic energy recovery system according to claim 15 wherein said motor-pump and supply pump form a hydraulic transformer feeding more energy into said energy storage as compared to feeding solely by said motor-pump.

19. A hydraulic energy recovery system according to claim 15 wherein a pressure sensor is connected to said pressure line and records pressure values for a central control.

20. A hydraulic energy recovery system according to claim 15 wherein said motor-pump unit and said energy storage are connected by supply lines to form a secondary hydraulic branch.

21. A hydraulic energy recovery system according to claim 20 wherein said secondary branch operates as a pump that supplies fluid pressure to said working hydraulics and to any other hydraulic consumers connected thereto, with energy for the fluid pressure originating from at least one of said first output drive or said energy storage; and said secondary branch operates as a motor that boosts at least one of said driver, said supply pump or connected units.

22. A hydraulic energy recovery system according to claim 15 wherein said motor-pump is operable in a four-quadrant operating mode and is electrically controllable by a central control.

23. A hydraulic energy recovery system according to claim 15 wherein a constant pressure valve is connected in a supply line extending from said motor-pump to said energy storage and comprises a 2/2-way switching valve.

24. A hydraulic energy recovery system according to claim 23 wherein a pressure sensor is connected to said supply line between said constant pressure valve and said energy storage and records pressure values for a central control.

25. A hydraulic energy recovery system according to claim 15 wherein said energy storage comprises a hydraulic accumulator.

26. A hydraulic energy recovery system according to claim 25 wherein said hydraulic accumulator is a bladder accumulator or a diaphragm accumulator.

27. A hydraulic energy recovery system according to claim 15 wherein said motor-pump is operable as a hydraulic transformer between said working hydraulics and said energy storage.

* * * * *